US011499685B1

(12) United States Patent
Flynn et al.

(10) Patent No.: US 11,499,685 B1
(45) Date of Patent: Nov. 15, 2022

(54) FIXTURE FOR A LIGHT ASSEMBLY

(71) Applicant: Alloy LED, LLC, Emeryville, CA (US)

(72) Inventors: Joseph Flynn, Oakland, CA (US); Wyanne Tsang, Nova Scotia (CA); Max Darling, Oakland, CA (US)

(73) Assignee: Alloy LED, LLC, Emeryville, CA (US)

( * ) Notice: Subject to any disclaimer, the term of this patent is extended or adjusted under 35 U.S.C. 154(b) by 0 days.

(21) Appl. No.: 17/569,452

(22) Filed: Jan. 5, 2022

(51) Int. Cl.

| | |
|---|---|
| ***F21S 4/20*** | (2016.01) |
| ***F21S 8/02*** | (2006.01) |
| ***F21S 4/24*** | (2016.01) |
| ***F21V 21/02*** | (2006.01) |
| ***F21Y 115/10*** | (2016.01) |

(52) U.S. Cl.
CPC . *F21S 4/20* (2016.01); *F21S 4/24* (2016.01); *F21S 8/02* (2013.01); *F21S 8/024* (2013.01); *F21S 8/026* (2013.01); *F21V 21/025* (2013.01); *F21Y 2115/10* (2016.08)

(58) Field of Classification Search
CPC ..... F21S 4/24; F21S 4/20; F21S 8/024; F21S 8/026; F21V 21/025
See application file for complete search history.

(56) References Cited

U.S. PATENT DOCUMENTS

| | | | | |
|---|---|---|---|---|
| 9,897,294 | B2 * | 2/2018 | Pearson | F21V 15/01 |
| 10,724,720 | B1 * | 7/2020 | Heredia | F21V 21/35 |
| 2009/0257219 | A1 * | 10/2009 | Doubek | F21V 21/04 362/147 |
| 2011/0084627 | A1 * | 4/2011 | Sloan | F21V 7/22 362/225 |
| 2012/0182747 | A1 * | 7/2012 | Doubek | F21V 17/164 362/390 |
| 2015/0292719 | A1 * | 10/2015 | Park | F21V 23/06 362/217.05 |
| 2021/0231289 | A1 * | 7/2021 | Pruitt | F21V 3/02 |

* cited by examiner

*Primary Examiner* — William N Harris
(74) *Attorney, Agent, or Firm* — Dragon Sun Law Firm, PC; Jinggao Li; Nathaniel Perkins

(57) ABSTRACT

A fixture adapted to be arranged inside a wall for mounting at least one tape light is disclosed. The fixture includes a mounting plate adapted to be mounted inside a wall and defining at least two arcuate slots extending proximate to an edge of the mounting plate to facilitate an engagement of the mounting plate to a mounting structure arranged inside the wall. The mounting plate defines at least one hole extending from a first surface to a second surface. The fixture includes an end cap removably engaged to the mounting plate and having a housing portion defining a chamber to receive an electrical connector and having a base defining a groove arranged aligned with the at least one hole of the mounting plate. The groove and the hole facilitate an extension of a plurality of wires.

20 Claims, 10 Drawing Sheets

FIXTURE FOR A LIGHT ASSEMBLY

TECHNICAL FIELD

The present invention pertains to a light assembly. More particularly, the present invention pertains to a fixture for mounting a tape light inside a wall or a ceiling.

BACKGROUND

Tape lights with a plurality of light-emitting diodes have become increasingly popular in various applications of lightning, such as home decoration and office decoration. Tape lights can be used in edge lightening systems to provide lightening that illuminates an area. To mount the tape lights inside the ceiling, wall, or drywalls, the lightening fixtures having lighting sockets or other electrical hardware are installed precisely in the mounting surface or behind the dry wall. For mounting the lightening fixtures substantial construction is required for even taping into the current electrical source, or even to run electrical wiring to the lightening fixture's intended location. This results in relatively inflexible lightening construction requiring precise planning to install, which is laborious and time consuming. Moreover, the electrical hardware, such as, electrical connectors connecting the tape light to the electrical wires may result into a presence of dark spot at one end of the light, which is undesirable.

SUMMARY

According to an aspect of the disclosure a fixture is disclosed. The fixture is adapted to be arranged inside a wall for mounting at least one tape light having a plurality of light emitting diodes and an electrical connector connected to the tape light. The fixture includes a mounting plate adapted to be mounted inside the wall and defining at least two arcuate slots extending proximate to an edge of the mounting plate to facilitate an engagement of the mounting plate to a mounting structure arranged inside the wall. Further, the mounting plate includes at least one hole extending from a first surface to a second surface arranged opposite to the first surface. In addition, the fixture includes an end cap removably engaged to the mounting plate and having a housing portion defining a chamber to receive the electrical connector. The housing portion has a base defining a groove arranged aligned with the at least one hole of the mounting plate. The groove and the hole facilitate an extension of a plurality of wires to the electrical connector to power the tape light.

In an embodiment, the housing portion includes a pair of parallel walls extending outwardly from the base, and a rear wall extending outwardly from the base and arranged between the pair of the parallel walls. The end cap includes a cover adapted to be removably engaged with the walls and the rear wall covering an access opening of the housing portion. The cover is an opaque cover In an embodiment, the housing portion includes a front opening defined between the pair of walls and the base to facilitate an extension of the tape light outside the housing portion.

In an embodiment, the fixtures further include a conduit extending through the groove and the hole, wherein the plurality of wires extends through the conduit.

In an embodiment, the fixture also includes an elongated channel structure adapted to be removably coupled to the housing portion and receive the tape light from the housing portion. Further, the fixture includes a lens removably coupled to the channel structure and covering the channel structure to facilitate a passage of light from the light emitting diodes to an ambient.

In an embodiment, the at least one hole includes a first hole and a second hole and the housing portion is a first housing portion. The groove is aligned with the first hole and the tape light is a first tape light. The end cap further includes a second housing portion defining a cavity and a bottom defining an opening aligned with the second hole to facilitate an extension of a plurality of cables to an electrical terminal to power a second tape light.

In an embodiment, the end cap includes a cover removably engaged to the second housing portion. The cover is an opaque cover.

In an embodiment, the fixture further includes a conduit extending through the opening and the second hole. The plurality of cables extends through the conduit.

In an embodiment, the end cap includes a channel portion having a substantially L-shape. The first housing portion and the second housing portion intersects with the channel portion and respectively receive the first tape light and the second tape light from the first housing portion and the second housing portion. The end cap also includes at least one lens covering the channel portion to facilitate an exit of the light from the first tape light and the second tape light to an ambient.

In an embodiment, the channel portion includes a first sidewall and a second sidewall arranged spaced apart and opposite to the first side wall. The first tape light is supported on the first sidewall and the second tape light is supported on the second sidewall.

According to an aspect a light assembly is disclosed. The light assembly includes at least one tape light having a plurality of light emitting diodes and an electrical connector connected to the tape light. The light assembly also includes a mounting plate adapted to be mounted inside the wall and defining at least two arcuate slots extending proximate to an edge of the mounting plate to facilitate an engagement of the mounting plate to a mounting structure arranged inside the wall. Further, the mounting plate defines at least one hole extending from a first surface to a second surface arranged opposite to the first surface. In addition, the light assembly includes an end cap removably engaged to the mounting plate and adapted to be arranged inside the wall and having a housing portion defining a chamber to receive the electrical connector and having a base defining a groove arranged aligned with the at least one hole of the mounting plate. The groove and the hole facilitate an extension of a plurality of wires to the electrical connector to power the at least one tape light In an embodiment, the housing portion includes a pair of parallel walls extending outwardly from the base, and a rear wall extending outwardly from the base and arranged between the pair of the parallel walls. The end cap includes a cover adapted to be removably engaged with the sidewalls and the rear wall covering an access opening of the housing portion, the cover is an opaque cover In an embodiment, the housing portion incudes a front opening defined between the pair of walls and the base to facilitate an extension of the tape light outside the housing portion.

In an embodiment, the light assembly also includes a conduit extends through the groove and the hole. The plurality of wires extends through the conduit.

In an embodiment, the light assembly includes an elongated channel structure adapted to be removably coupled to the housing portion and receive the tape light from the housing portion. Further, the light assembly includes a lens removably coupled to the channel structure and covering the channel structure to facilitate a passage of light from the light emitting diodes to an ambient.

In an embodiment, the at least one hole includes a first hole and a second hole, the housing portion is a first housing portion and the tape light is a first tape light. The groove is aligned with the first hole. The end cap further includes a second housing portion defining a cavity and a bottom defining an opening aligned with the second hole to facilitate an extension of a plurality of cables to an electrical terminal to power a second tape light.

In an embodiment, the end cap includes a cover removably engaged to the second housing portion. The cover is an opaque cover.

In an embodiment, the light assembly further includes a conduit extending through the opening and the second hole. The plurality of cables extends through the conduit.

In an embodiment, the end cap includes a channel portion having a substantially L-shape. The first housing portion and the second housing portion intersects with the channel portion and respectively receive the first tape light and the second tape light from the first housing portion and the second housing portion. The end cap also includes at least one lens covering the channel portion to facilitate an exit of the light from the first tape light and the second tape light to an ambient.

In an embodiment, the channel portion includes a first sidewall and a second sidewall arranged spaced apart and opposite to the first side wall. The first tape light is supported on the first sidewall and the second tape light is supported on the second sidewall.

For a more complete understanding of the present invention, reference is made to the following detailed description and accompanying drawings. In the drawing, like reference characters refer to like parts throughout the views in which.

DETAILED DESCRIPTION

Figure 1:
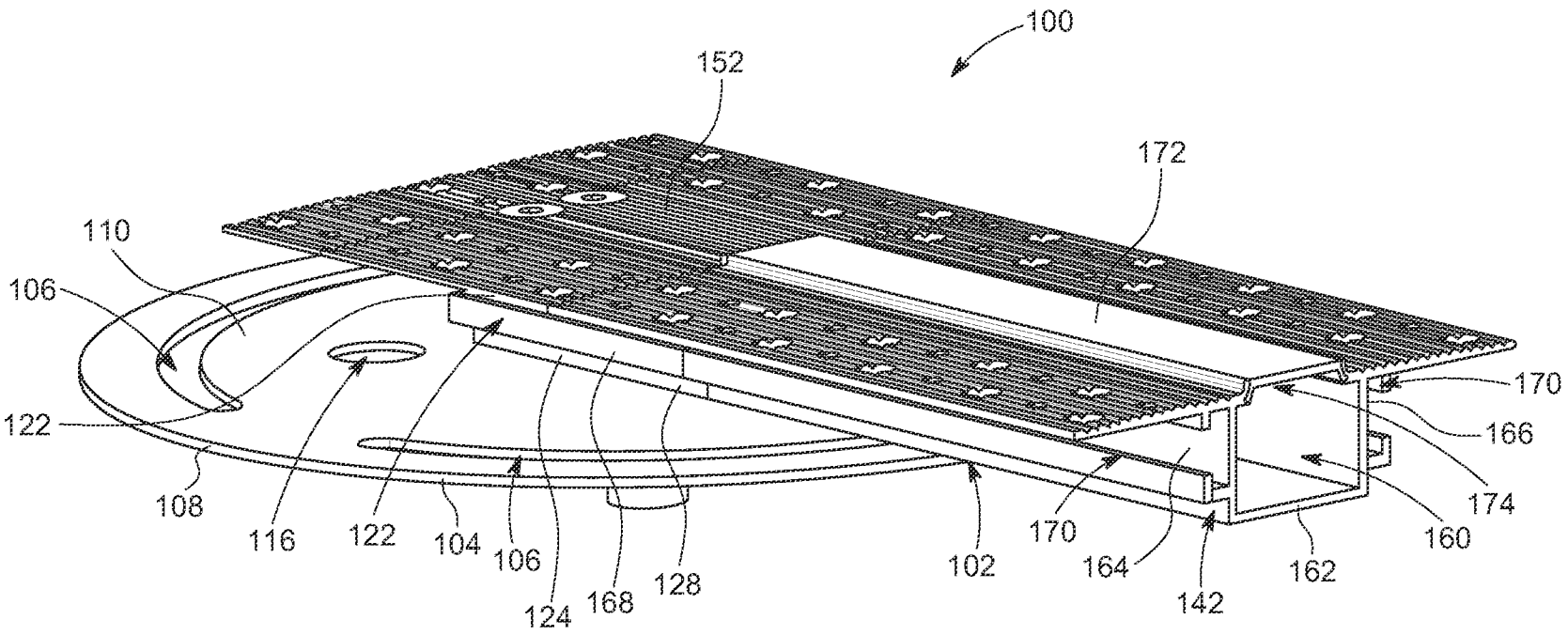
FIG. 1 illustrates a perspective view of a light assembly, in accordance with an embodiment of the disclosure.

Example embodiments are described below with reference to the accompanying drawings. Unless otherwise expressly stated in the drawings, the sizes, positions, etc., of components, features, elements, etc., as well as any distances therebetween, are not necessarily to scale, and may be disproportionate and/or exaggerated for clarity.

The terminology used herein is for the purpose of describing example embodiments only and is not intended to be limiting. As used herein, the singular forms "a," "an" and "the" are intended to include the plural forms as well, unless the context clearly indicates otherwise. It should be recognized that the terms "comprise," "comprises," and/or "comprising," when used in this specification, specify the presence of stated features, integers, steps, operations, elements, and/or components, but do not preclude the presence or addition of one or more other features, integers, steps, operations, elements, components, and/or groups thereof. Unless otherwise specified, a range of values, when recited, includes both the upper and lower limits of the range, as well as any sub-ranges therebetween. Unless indicated otherwise, terms such as "first," "second," etc., are only used to distinguish one element from another. For example, one element could be termed a "first element" and similarly, another element could be termed a "second element," or vice versa. The section headings used herein are for organizational purposes only and are not to be construed as limiting the subject matter described.

Unless indicated otherwise, the terms "about," "thereabout," "substantially," etc. mean that amounts, sizes, formulations, parameters, and other quantities and characteristics are not and need not be exact, but may be approximate and/or larger or smaller, as desired, reflecting tolerances, conversion factors, rounding off, measurement error and the like, and other factors known to those of skill in the art.

Spatially relative terms, such as "right," left," "below," "beneath," "lower," "above," and "upper," and the like, may be used herein for ease of description to describe one element's or feature's relationship to another element or feature, as illustrated in the drawings. It should be recognized that the spatially relative terms are intended to encompass different orientations in addition to the orientation depicted in the figures. For example, if an object in the figures is turned over, elements described as "below" or "beneath" other elements or features would then be oriented "above" the other elements or features. Thus, the term "below" can, for example, encompass both an orientation of above and below. An object may be otherwise oriented (e.g., rotated 90 degrees or at other orientations) and the spatially relative descriptors used herein may be interpreted accordingly.

Unless clearly indicated otherwise, all connections and all operative connections may be direct or indirect. Similarly, unless clearly indicated otherwise, all connections and all operative connections may be rigid or non-rigid.

Like numbers refer to like elements throughout. Thus, the same or similar numbers may be described with reference to other drawings even if they are neither mentioned nor described in the corresponding drawing. Also, even elements that are not denoted by reference numbers may be described with reference to other drawings.

Many different forms and embodiments are possible without deviating from the spirit and teachings of this disclosure and so this disclosure should not be construed as limited to the example embodiments set forth herein. Rather, these example embodiments are provided so that this disclosure will be thorough and complete, and will convey the scope of the disclosure to those skilled in the art.

Reference in this specification to "one embodiment" or "an embodiment" means that a particular feature, structure, or characteristic described in connection with the embodiment is included in at least one embodiment of the present disclosure. The appearance of the phrase "in one embodiment" in various places in the specification are not necessarily all referring to the same embodiment, nor are separate or alternative embodiments mutually exclusive of other embodiments.

Figure 2:
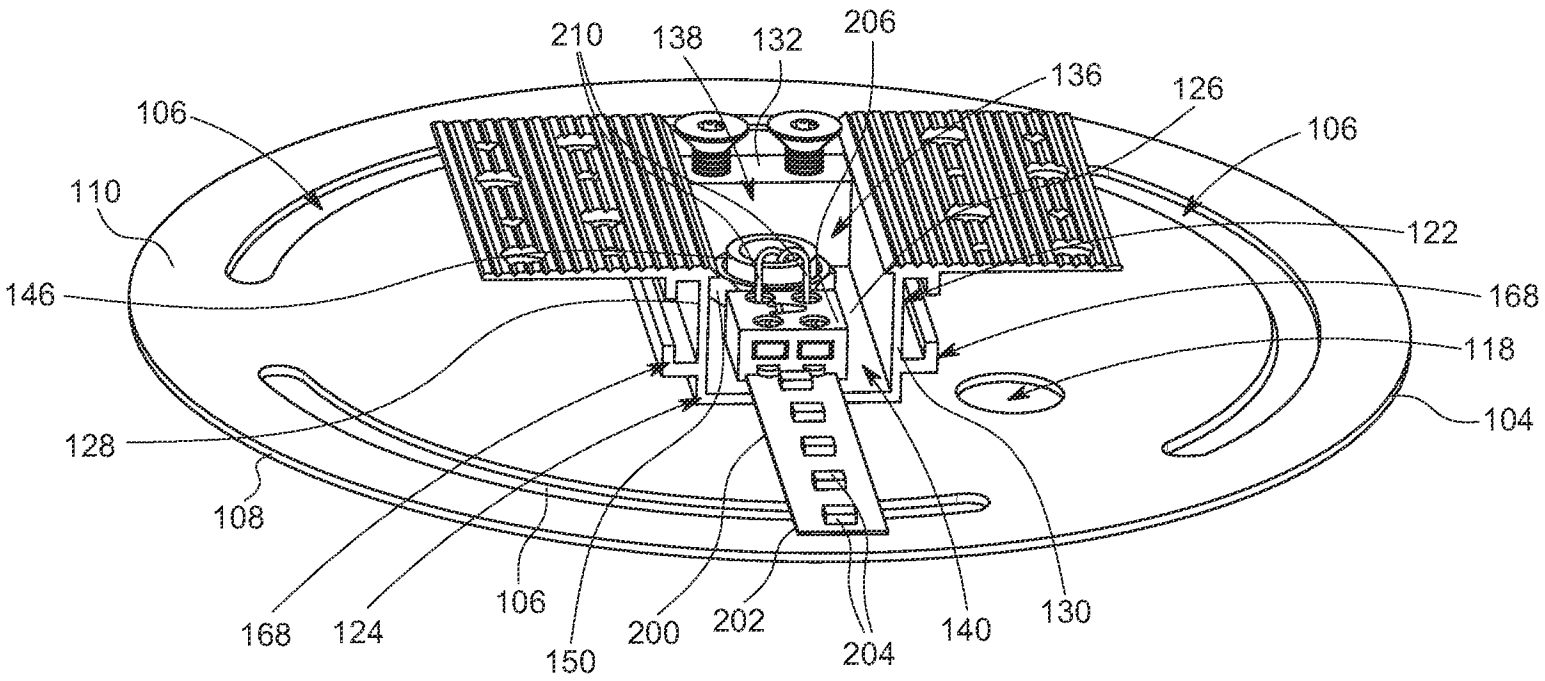
FIG. 2 illustrates a top perspective view of the light assembly of FIG. 1 with a channel structure and a cover removed, in accordance with an embodiment of the disclosure.

Referring to FIG. 1 to FIG. 5, a light assembly 100 is shown. As shown in FIG. 2, the light assembly 100 includes a fixture 102 adapted to facilitate a mounting of at least one tape light, for example, a tape light 200, inside a wall/drywall/ceiling of a room. The tape light 200 includes a tape 202 or a strip and a plurality of light emitting diodes (LEDs) 204 arrayed along a length of the tape 202 and suitable to adhesively engage to a surface. Further, the tape light 200 includes an electrical connector 206 connected to an end of the tape 202 to facilitate an electrical connection of the tape light 200 with an external power source to provide electricity to the plurality of LEDs 204.

Figure 3:
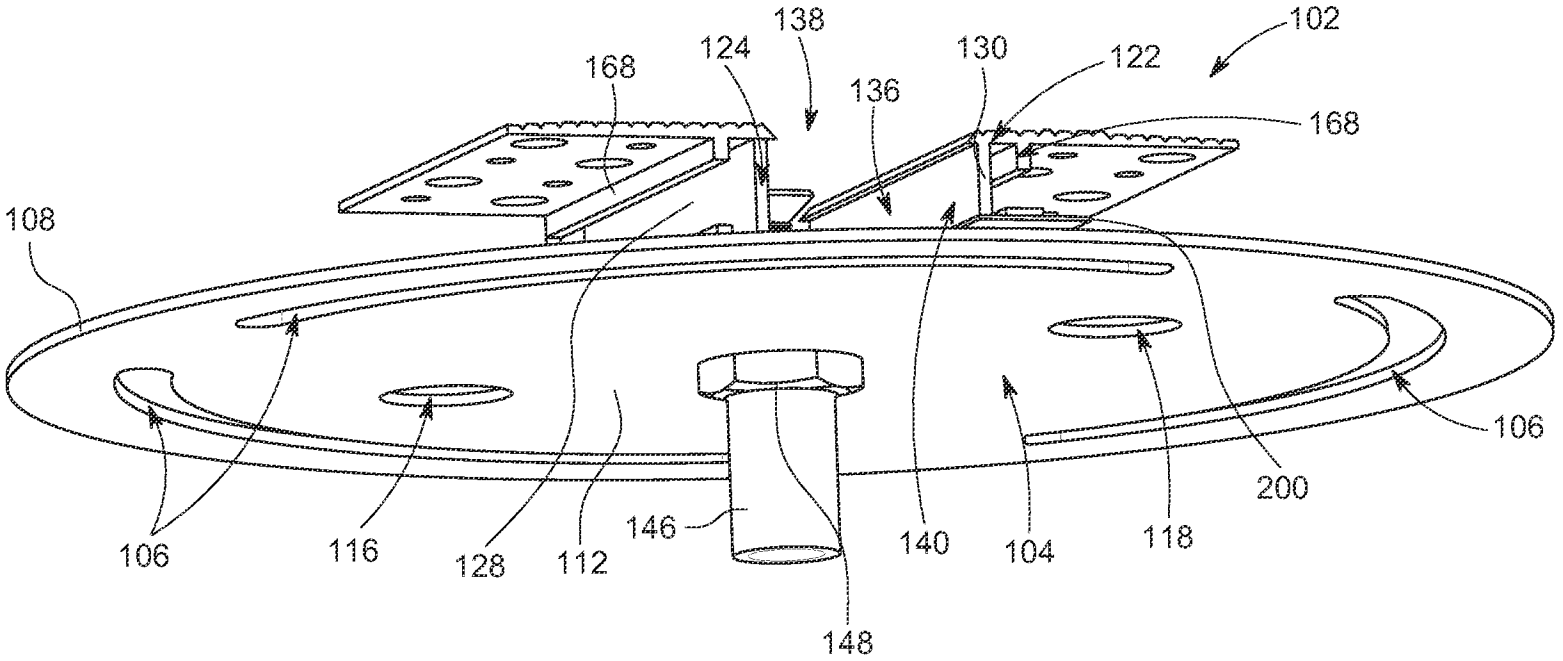
FIG. 3 illustrates a bottom perspective view of light assembly of FIG. 1 with the channel structure and the cover removed, in accordance with an embodiment of the disclosure.
Figure 4:
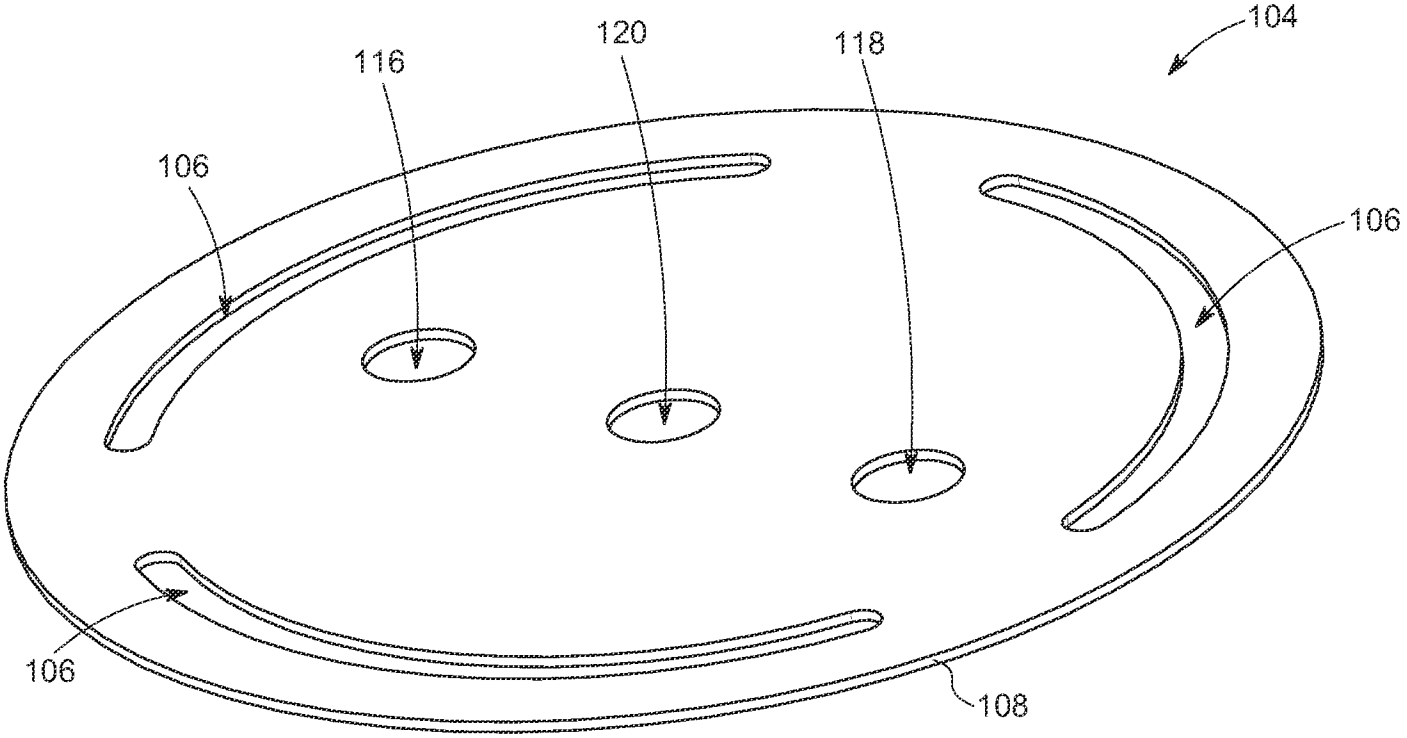
FIG. 4 illustrates a top perspective view of a mounting plate of a fixture of the light assembly, in accordance with an embodiment of the disclosure.

As shown in FIGS. 1 to 3, the fixture 102 includes a mounting plate 104 adapted to be mounted to a suitable mounting structure arranged or positioned inside the drywall. In an embodiment, the mounting structure may be a junction box or a telescopic screw gun bracket (TSGB), or any other suitable structure known in the art. In the embodiment, the mounting plate 104 (simply referred to as plate 104) is a circular plate and is adapted to rotate about a central axis of the mounting plate 104 relative to the mounting structure to enable the positioning of the mounting plate 104, and hence the fixture 102, at any desired angular orientation. To facilitate the coupling or mounting of the plate 104 at any desired angular orientation, the plate 104 defines a plurality of arcuate slots 106, three slots are shown, extending angularly around the central axis of the plate 104 such that a center of the plate 104 is disposed between the arcuate slots 106.

As shown in FIGS. 1 to 4, each of the slots 106 is in the form of an arc of a circle and are arranged proximate to an outer edge of 108 of the plate 104 relative to the center. In an embodiment, the arcs of the slots 106 subtend an obtuse angle at the center of the plate 104. The slots 106 are through slots extending from a first surface 110 of the plate 104 to a second surface 112 (shown in FIG. 3) of the plate 104 disposed opposite to the first surface 110. A plurality of fasteners (not shown) may extend through the slots 106 to engage/couple the plate 104 with the mounting structure. Additionally, the plate 104 defines at least one through hole, for example, a first hole 116 (shown in FIG. 1, FIG. 3, and FIG. 4), a second hole 118 (shown in FIGS. 2, 3, and 4), and a central hole 120 (shown in FIG. 4) disposed centrally to the plate 104. As shown, the first hole 116 is arranged between one of the slots 106 and the central hole 120, and the second hole 118 is arranged opposite to the first hole 116 and between another slot 106 and the central hole 120. The holes 116, 118, 120 are through holes and extend from the first surface 110 to the second surface 112.

Figure 5:
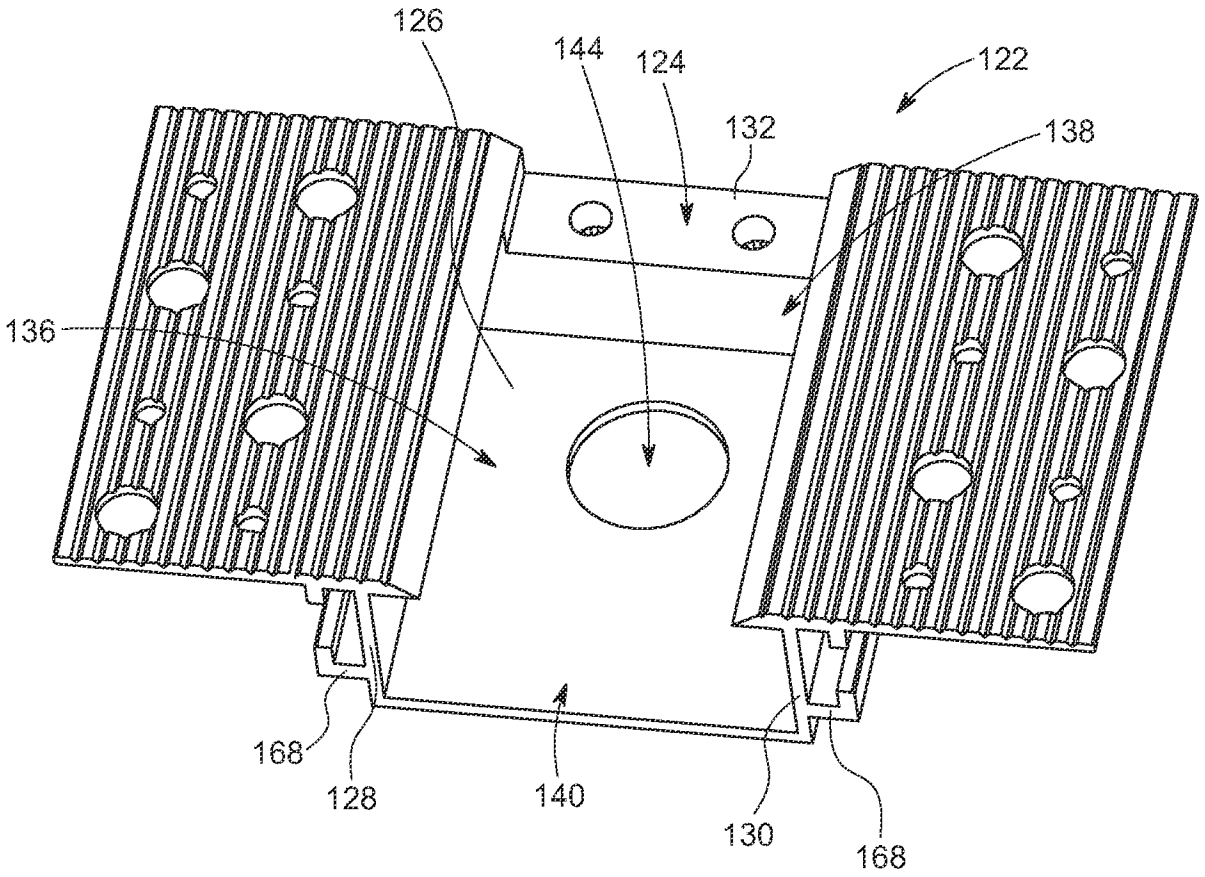
FIG. 5 illustrates a top perspective view of an end cap of the light assembly with cover removed, in accordance with an embodiment of the disclosure.

Moreover, the fixture 102 includes an end cap 122 removably engaged to the plate 104 and adapted to be arranged inside the wall. As shown in FIGS. 2, 3 and 5, the end cap 122 includes at least one housing portion, for example, a housing portion 124 having a base 126, a pair of walls 128, 130 extending outwardly and perpendicularly to the base 126, and a rear wall 132 extending perpendicularly to the base 126. The pair of walls, for example, a first wall 128 and a second wall 130, are arranged spaced apart from each other and are located substantially parallel to each other, while the rear wall 132 extends from the first wall 128 to the second wall 130. Accordingly, a chamber 136 of the housing portion 124 is defined between the base 126, the walls 128, 130, and the rear wall 132. Further, free longitudinal edges of the walls 128, 130 and the rear wall 132 arranged opposite to the base 126 together define an access opening 138 of the chamber 136, while housing portion 124 also defines a front opening 140, arranged opposite to the rear wall 132, through which the tape light 200 extends into a channel structure 142 (shown in FIG. 1) of the fixture 102.

Moreover, the end cap 122, i.e., the housing portion 124, includes at least one groove, for example, a groove 144 (shown in FIG. 5), extending through the base 126 of the housing portion 124. The groove 144 facilitates an insertion of a plurality of wires 210 inside the housing portion 124 (i.e., the chamber 136) to provide electric power to the tape light 200. In an embodiment, the groove 144 also enables the removably coupling of the end cap 122 with the plate 104. In an assembly of the end cap 122 with the plate 104, the groove 144 is aligned with the at least one hole, for example, the central hole 120, and a conduit 146 of the fixture 102 extends through the groove 144 and the central hole 120 to enable the attachment of the end cap 122 with the plate 104 and a passage of the plurality of wires 210 inside the chamber 136 from a power source. As shown, the conduit 146 is engaged with the plate 104 and the end cap 122 via a first threaded bolt 148 and a second threaded bolt 150, respectively. The wires 210 are coupled to the electrical connector 206 arranged inside the chamber 136. Additionally, the end cap 122 includes a removable cover 152 (shown in FIG. 1) adapted to removably engaged with the housing portion 124 and adapted to extend from the rear wall 132 to the front opening 140 and covering the access opening 138. It may be appreciated that the cover 152 is an opaque cover and prevents a transmission of light to an ambient i.e., the room, from a portion of the tape light 200 arranged inside the chamber 136. It may be appreciated that the tape light 200 extends inside the channel structure 142 from the housing portion 124 through the front opening 140. The channel structure 142 supports the tape light 200 and facilitates the transmission of light from the tape light 200 to the ambient.

Figure 6:
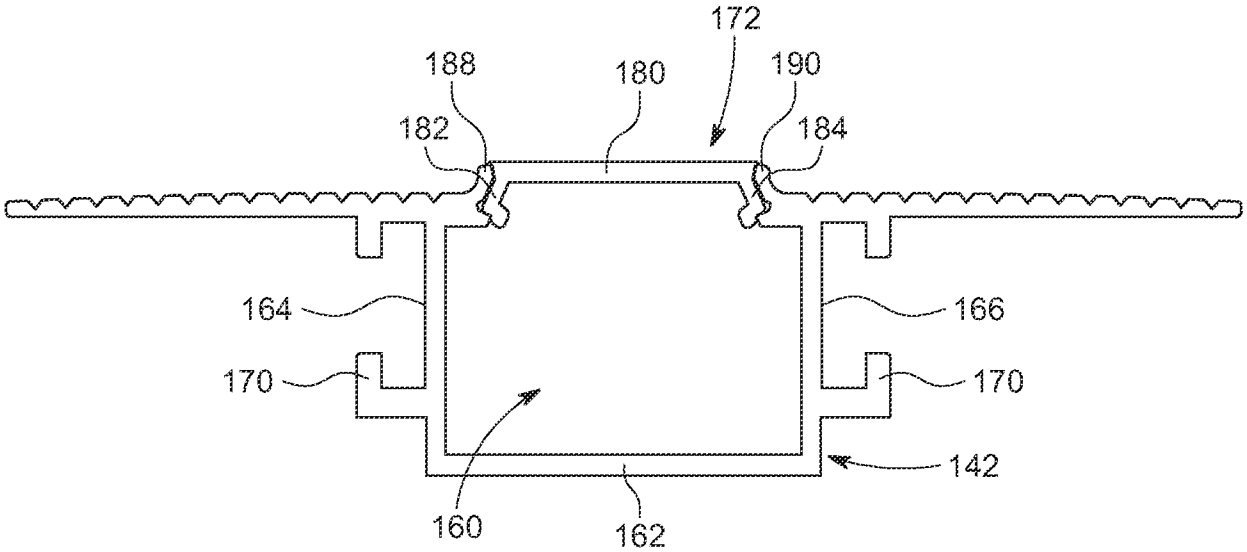
FIG. 6 illustrates a front view of a channel structure engaged with a lens, in accordance with an embodiment of the disclosure.

As shown in FIG. 1 and FIG. 6, the channel structure 142 defines an elongated passage 160 and has a base 162 and a pair of sidewalls 164, 166 arranged spaced apart and extending outwardly in a vertical direction from the base 162. The channel structure 142 is a straight channel having a longitudinal end connected to the housing portion 124. As shown, each of the pair of the walls 128, 130 of the housing portion 124 includes a C-shaped structure 168 arranged outside the chamber 136 and each of the sidewalls 164, 166 of the channel structure 142 also includes a C-shaped structure 170 arranged outside the passage 160. The channel structure 142 is attached to the housing portion 124 (i.e., the end cap 122) by inserting the link bars (not shown) through the C-shaped structures 168 of the walls 128, 130 and the C-shaped structures 170 of the sidewalls 164, 166. Moreover, the fixture 102 includes a lens 172 removably engaged to the channel structure 142 to cover of an access opening 174, arranged opposite to the base 162 of the channel structure 142, of the elongated passage 160. The lens 172 is at least partially transparent lens and allows a passage of the light emitted by the LEDs 204 of the tape light 200 to the room. It may be appreciated that the end cap 122 described above is used for mounting a straight edge light assembly. In an embodiment, as shown in FIG. 6, the lens 172 includes a base structure 180 and a pair of legs 182, 184 extending vertically from the base structure 180. As shown, the pair of legs, for example, a first leg 182 extends from a first end of the base structure 180 and a second leg 184 extends from a second end of the base structure 180 and are arranged facing each other. Accordingly, the lens 172 reduces the overhang portions the base structure 180 extending outwardly from the legs 182, 184 or omit the overhang portions existing with the prior art lens. Also, the legs 182, 184 extend obliquely and outwardly from the ends of the base structure 180. Accordingly, and obtuse angle is defined between each of the legs 182, 184 and base structure 180. A light originating from an LED arranged at a center of the base 162 of the channel structure 142 passes through lesser lens material and hence reduces the occurrence and/or intensity of dark spots at the interface of the lens 172 (i.e., the base structure 180) and the channel structure 142. The base structure 180 is adapted to be arranged facing the base 162 of the channel structure 142 and covering the access opening 174, while the legs 182, 184 are engaged with the vertically extending legs 188, 190 of the channel structure 142.

Figure 7:
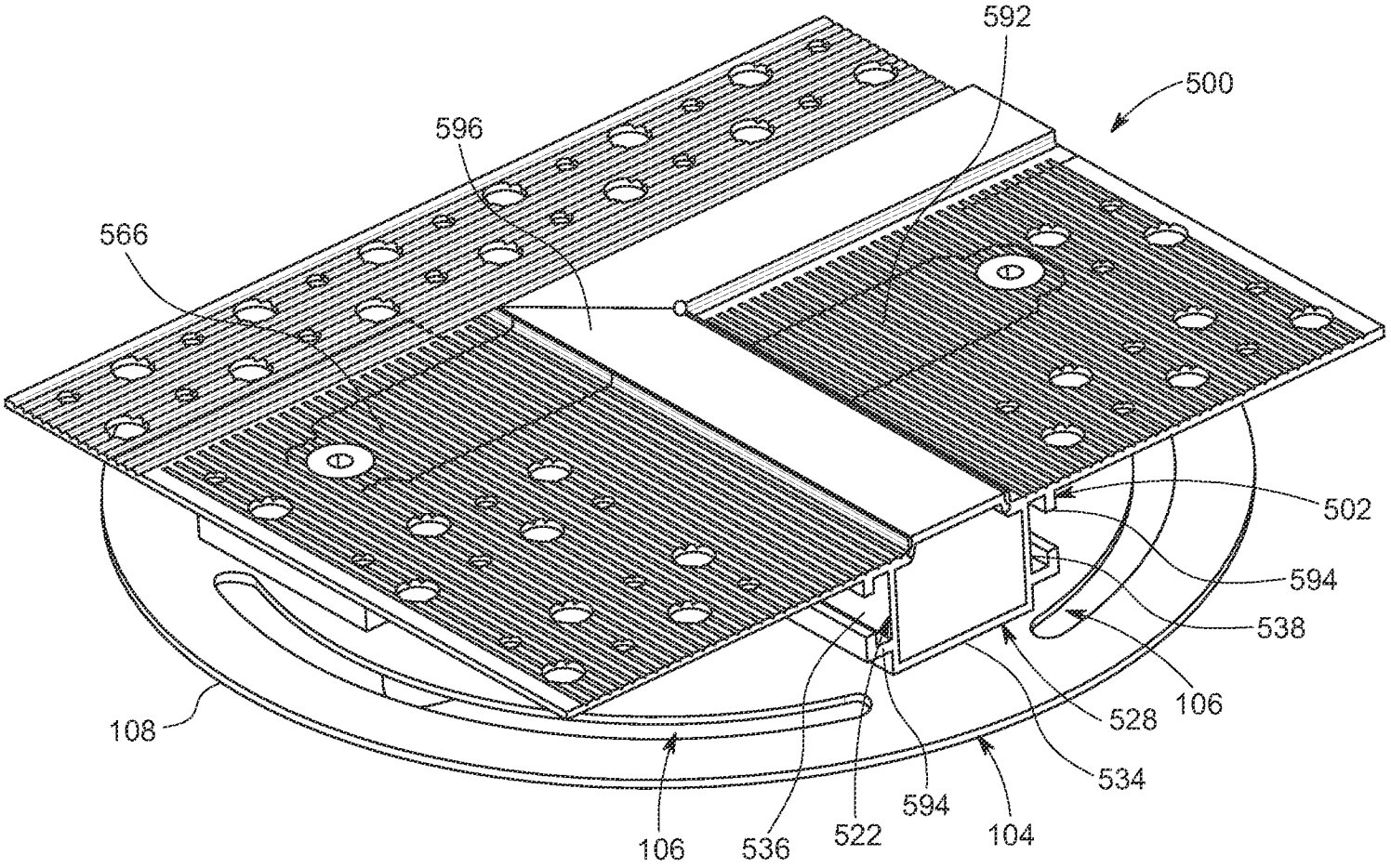
FIG. 7 illustrates a perspective view of a light assembly, in accordance with an embodiment of the disclosure.
Figure 8:
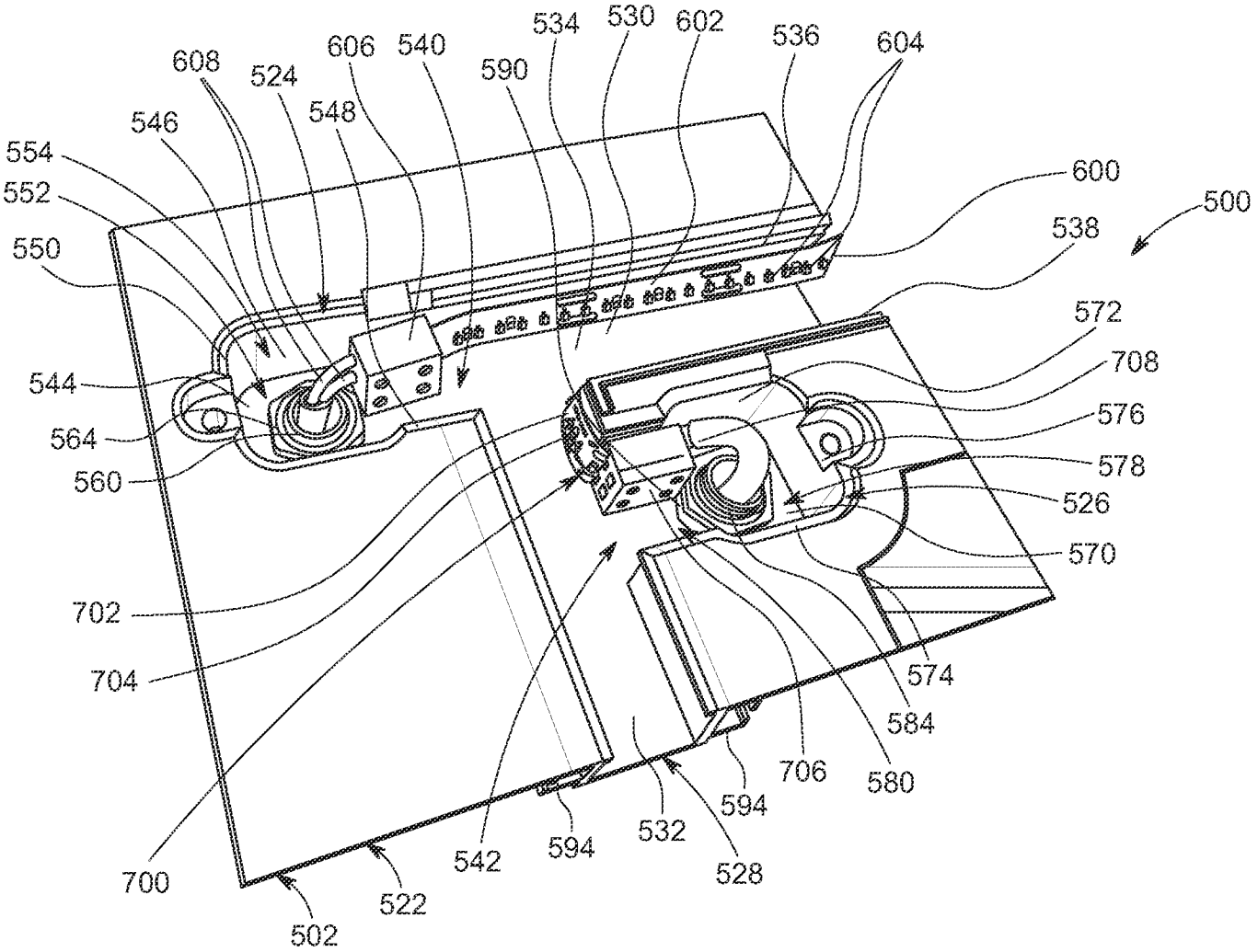
FIG. 8 illustrates a top perspective view of the light assembly of FIG. 7 with a first cover, a second cover, and a lens removed, in accordance with an embodiment of the disclosure.

Referring to FIGS. 7 to 10, a light assembly 500 according to an alternative embodiment of the disclosure. The light assembly 500 is a loop type light assemble. As shown in FIG. 8, the light assembly 500 includes at least one tape light having a first tape light 600 having a tape 602 and plurality of LEDs 604 arrayed on a surface of the tape 602 and a second tape light 700 having a tape 702 and a plurality of LEDs 704 arrayed on a surface of the tape 702, an electrical connector 606 connected to the first tape light 600 to facilitate an electrical connection of the first tape light 600 with a plurality of wires 608, and an electrical terminal 706 connected to the second tape light 700 to facilitate an electrical connection of the second tape light 700 with a plurality of cables 708. The first tape light 600 and the second tape light 700 are identical to the tape light 200.

Figure 9:
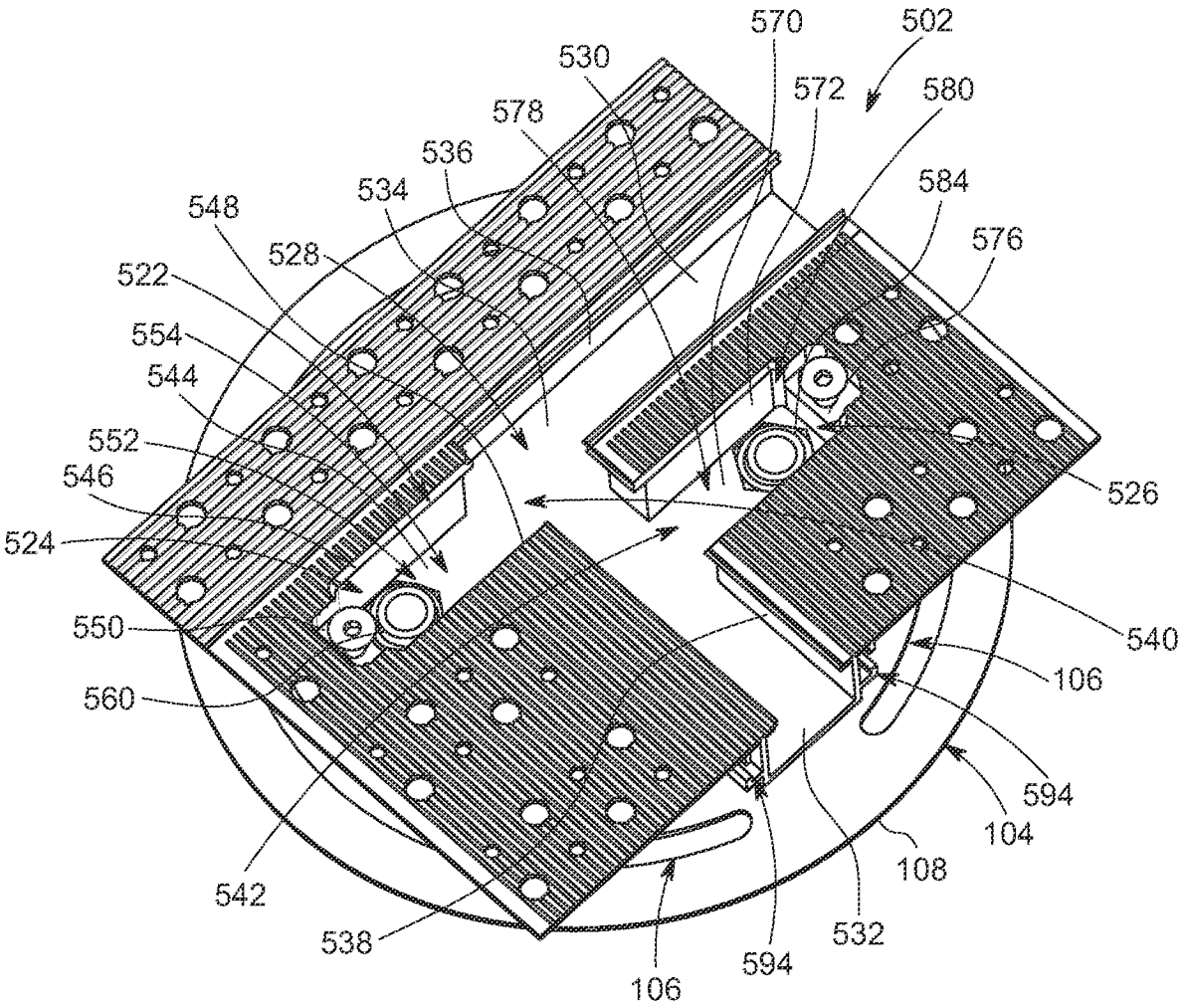
FIG. 9 illustrates a top perspective view of a fixture of the light assembly of FIG. 7 with the first cover, the second cover, and the lens removed, in accordance with an embodiment of the disclosure.

Referring to FIGS. 7 to 9, the light assembly 500 also includes at least one fixture, for example, a fixture 502, for mounting the first tape light 600 and the second tape light 700 to a wall, a drywall, or a ceiling of a room. In an embodiment, the light assembly 500 is square type or a rectangular type edge lighting assembly. In such a case, the fixture 502 is disposed at a corner of the square or the rectangle. The fixture 502 includes the mounting plate 104 and an end cap 522 removably coupled to the plate 104. The plate 104 is attached to a mount structure, such as, but not limited to, a junction box, a TSGB bracket, etc. via a plurality of fasteners (not shown) extending through the slots 106 of the plate 104.

Figure 10:
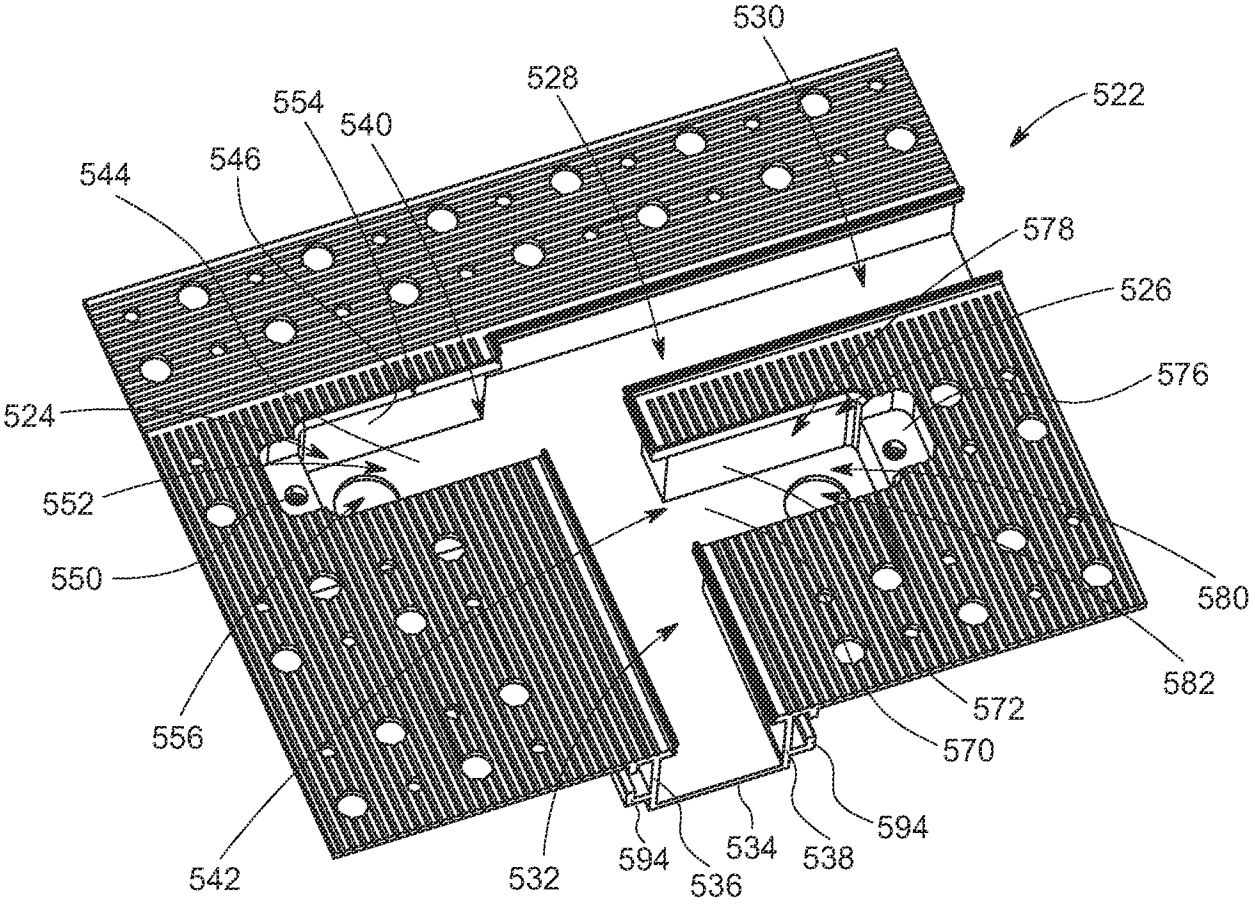
FIG. 10 illustrates a top perspective view of an end cap of the light assembly of FIG. 7 with the first cover, the second cover, and the lens removed, in accordance with an embodiment of the disclosure.

As shown in FIGS. 8 to 10, the end cap 522 includes a first housing portion 524, a second housing portion 526, and a channel portion 528 arranged between the first housing portion 524 and the second housing portion 526. Accordingly, the first housing portion 524 and the second housing portion 526 may be arranged on the opposite sides of the channel portion 528, and includes an L-shape having a first elongated portion 530 and a second elongated portion 532 arranged substantially perpendicularly to the first elongated portion 530. As shown, the channel portion 528 includes a base 534 and a pair of sidewalls 536, 538 extending outwardly and vertically from the base 534 and arranged spaced apart from each other. The first tape light 600 extends inside the channel portion 528 along a first sidewall 536 of the pair of sidewalls 536, 538 and the second tape light 700 extends inside the channel portion 528 along a second sidewall 538 of the pair of sidewalls 536, 538. It may be appreciated that the tape lights 600, 700 exit the end cap 522 through one of the portions, for example, the first elongated portion 530, of the channel portion 528, and enter back the channel portion 528 through the other portion, for example, the second elongated portion 532, of the channel portion 528 to complete the loop. Further, the first tape light 600 enters the channel portion 528 through a front opening 540 of the first housing portion 524, while the second tape light 700 enters the channel portion 528 through a front opening 542 of the second housing portion 526.

The first housing portion 524 has a base 544, a pair of walls 546, 548 extending outwardly and perpendicularly to the base 544, and a rear wall 550 extending perpendicularly to the base 544. The pair of walls, for example, a first wall and 546 and a second wall 548, are arranged spaced apart from each other and located substantially parallel to each other, while the rear wall 550 extends from the first wall 546 to the second wall 548. Accordingly, a chamber 552 of the first housing portion 524 is defined between the base 544, the walls 546, 548, and the rear wall 550. Further, free edges of the walls 546, 548 and the rear wall 550 arranged opposite to the base 544 together define an access opening 554 of the chamber 552, while the first housing portion 524 also defines the front opening 540 at an intersection of the channel portion 528 (e.g., the first portion 530) with the first housing portion 524. Moreover, the first housing portion 524 includes at least one groove, for example, a first groove 556 (shown in FIG. 10), extending through the base 544 of the first housing portion 524. The first groove 556 facilitates an insertion of a plurality of wires 608 inside the first housing portion 524 to provide electric power to the first tape light 600. In an embodiment, the first groove 556 also enables the removably coupling of the end cap 522 with the plate 104. In an assembly of the end cap 522 with the plate 104, the first groove 556 is aligned with the at least one hole, for example, the first hole 116, and a conduit, for example, a first conduit 560, of the fixture 502 extends through the first groove 556 and the first hole 116 to enable the attachment of the end cap 522 with the plate 104 and a passage of the plurality of wires 608 inside the chamber 552 from a power source. As shown, the first conduit 560 is engaged with the plate 104 and the end cap 522 via a first threaded bolt (not shown) and a second threaded bolt 564 respectively. The wires 608 are coupled to the electrical connector 606 arranged inside the chamber 552. Additionally, the end cap 522 includes a removable cover 566 (hereinafter referred to as a first cover 566), best shown in FIG. 7, removably engaged to the housing portion 524 and extending from the rear wall 550 to the front opening 540 to cover the access opening 554. It may be appreciated that the first cover 566 is an opaque cover and prevents a transmission of light to an ambient i.e., the room, from a portion of the first tape light 600 arranged inside the chamber 552.

The second housing portion 526 has a bottom 570 a pair of walls 572, 574 extending outwardly and perpendicularly to the bottom 570, and a rear wall 576 extending perpendicularly to the bottom 570. The pair of walls 572, 574, for example, a first wall 572 and a second wall 574, are arranged spaced apart from each other and located substantially parallel to each other, while the rear wall 576 extends from the first wall 572 to the second wall 574. Accordingly, a cavity 578 of the second housing portion 526 is defined between the bottom 570, the walls 572, 574, and the rear wall 576. Further, free edges of the walls 572, 574 and the rear wall 576, arranged opposite to the bottom 570, together define an access opening 580 of the cavity 578, while second housing portion 526 also defines the front opening 542, arranged opposite to the rear wall 576, through which the second tape light 700 extends into the channel portion 528 (i.e., second portion 532).

As shown, the front opening 542 is disposed at an intersection of the second portion 532 with the second housing portion 526. Moreover, the second housing portion 526 includes an opening 582 (shown in FIG. 10) that extends through the bottom 570 of the second housing portion 526. The opening 582 facilitates an insertion of the plurality of cables 708 inside the cavity 578 of the second housing portion 526 to provide an electric power to the second tape light 700. In an embodiment, the opening 582 also enables the removably coupling of the end cap 522 with the plate 104. In an assembly of the end cap 522 with the plate 104, the opening 582 is aligned with the at least one hole, for example, the second hole 118, and a conduit 584 (hereinafter referred to as second conduit 584) of the fixture 502 extends through the opening 582 and the second hole 118 to enable the attachment of the end cap 522 with the plate 104 and a passage of the plurality of cables 708 inside the cavity 578 from a power source. As shown, the second conduit 584 is engaged with the plate 104 and the end cap 522 via a third threaded bolt (not shown) and a fourth threaded bott 590 (shown in FIGS. 9 and 9) respectively. The cables 708 are coupled to the electrical terminal 706 arranged inside the cavity 578. Additionally, end cap 522 includes a removable cover 592 (hereinafter referred to as a second cover 592), shown in FIG. 7, removably engaged to the second housing portion 526 and extending from the rear wall 576 to the front opening 542 to cover the access opening 580 of cavity 578. It may be appreciated that the second cover 592 is an opaque cover and prevents a transmission of light to an ambient i.e., the room, from a portion of the second tape light 700 arranged inside the cavity 578.

Additionally, each of the pair of the sidewalls 536, 538 of the channel portion 528 includes a C-shaped structure 594 extending outside the channel portion 528. The c-shaped structures 594 may facilitate an engagement of the channel portion 528, and hence the end cap 522, with the channel structures 142 of the fixture 502. Moreover, the fixture 502 includes at least one lens 596 (shown in FIG. 7) removably engaged to the channel portion 528 and arranged opposite to the base 534 of the channel portion 528. The lens 596 allows a passage of the light emitted by the LEDs 604, 704 of the tape lights 600, 700 to the room. The lens 596 is identical in structure and constructure to the lens 172.

A method for mounting the light assembly 100 is now described. For mounting the light assembly 100, a technician may mount the plate 104 with the suitable mounting structure via the plurality of fasteners before the drywall is installed. After mounting the plate 104, a drywall installer installs the drywall such that the plate 104 is hidden inside/behind the drywall. Also, before installing the drywall, the technician may extend the conduit 146 through the central hole 120 of the plate 104 and mounts/attaches the conduit 146 with the plate 104 using the first threaded bolt 148.

The technician also extends the plurality of wires 210, connected to a power source, through the conduit 146. After installing the drywall, the technician may make an elongated cut into the drywall at the location where the endcap 122 and the channel structure 142 is to be mounted. It may be envisioned that the elongated cut is defined into the drywall such that the plate 104 is located at an end of the cut. Subsequently, the technician engages the end cap 122 with conduit 146 such that the conduit 146 extends through the groove 144 of the housing portion 124. The end cap 122 may be arranged at any angular orientation relative to the plate 104 by rotating the end cap 122 relative to the conduit 146. Before extending the conduit 146 through the groove 144, the cover 152 is disengaged from the housing portion 124.

Thereafter or otherwise, the technician may arrange the electrical connector 206 inside the chamber 136 and the connect the electrical wires 210 to the electrical connector 206. Further, the tape light 200 is also connected with the electrical connector 206. The tape light 200 extends outside the chamber 136 through the front opening 140 and is arranged/positioned along the base 126 of the housing portion 124. The technician also engages the channel structure 142 with the housing portion 124 by aligning the c-shaped structures 168 of the housing portion 124 with the c-shaped structures 170 of the channel structure 142 and inserting the link bars (not shown) inside the c-shaped structures 170 of the channel structure 142 and the c-shaped structures 168 of the housing portion 124. The channel structure 142 is arranged such that the channel structure 142 extends from the front opening 140 of the housing portion 124 and extends away from the housing portion 124. The tape light 200 is also positioned along the base 162 of the channel structure 142. Thereafter, the technician mounts the cover 152 on the housing portion 124 and arranges the end cap 122 and the channel structure 142 inside the drywall such that the channel structure 142 extends along the length of the elongated cut. The technician also engages the end cap 122 with the plate 104 vis the second threaded bolt 150. Subsequently, the technician engages the lens 172 or the lens with the channel structure 142 covering the access opening 174 of the channel structure 142. Now the drywall installer applies ultra-thin drywall tape to help with the mudding. This mudding is also helped by the large wings or flanges that extend out housing portion 124. The light assembly 100 and the fixture 102 are mudded into the wall so that only the lens 172 is visible, making a great looking and clean installation.

It may be envisioned that the light assembly 500 may be mounted/installed similar to the mounting/installation of the light assembly 100 except that the mounting plate 104 is arranged and attached at a desired orientation relative to the TSGB bracket by rotating the mounting plate 104 relative to the TSGB bracket to achieve a desired angular orientation of the end cap 522 relative to the drywall. Also, the first conduit 560 and the second conduit 584 are extended through the first hole 116 and the second hole 118 of the plate 104 and are coupled to the plate 104 by the threaded bolts. Thereafter, the end cap 522 is mounted to the plate 104 by extending the first conduit 560 and the second conduit 584 though the first groove 556 and the opening 582 of the end cap 522, respectively, and coupling the end cap 522 to the plate 104 in a manner similar to the coupling of the end cap 122 with the plate 104.

The light assembly 100, 500 provides a safe connection to a power source, and the end cap 122, 522 prevents the visibility of the electrical connector 206, 606 and the electrical terminal 706 and also a connection of the electrical connector 206, 606, and the electrical terminal 706 to the power source without creating a dark spot at the location of connection of the connector 206, 606 and the terminal. In addition, the light assembly 500 may be mounted at any angle desired by the user by rotating the plate 104 about its central axis to position the first hole 116 and the second hole 118 at any desired positions to mount the end cap 522 at any desired orientations relative to the drywall. The arcuate slots 106 of the plate 104 facilitates mounting of the plate 104 with the TSGB bracket or junction box corresponding to any desired positions of the first hole 116 and the second hole 118. Also, no additional wiring is required for the light assembly 100, 500 as it may be easily connected with a TSGB or runs the wires to a junction box to facilitate the electrical connection to the light assembly 100, 500. Also, the fixture 102, 502 allow for installing in-wall channels without having to have an electrician return to the site after installing the drywall.

It should be understood that the foregoing description is only illustrative of the aspects of the disclosed embodiments. Various alternatives and modifications can be devised by those skilled in the art without departing from the aspects of the disclosed embodiments. Accordingly, the aspects of the disclosed embodiments are intended to embrace all such alternatives, modifications, and variances that fall within the scope of the appended claims. Further, the mere fact that different features are recited in mutually different dependent or independent claims does not indicate that a combination of these features cannot be advantageously used, such as a combination remaining within the scope of the aspects of the disclosed embodiments.

What is claimed is:

1. A fixture adapted to be arranged inside a wall for mounting at least one tape light having a plurality of light emitting diodes and an electrical connector connected to the tape light, the fixture comprising:

a mounting plate adapted to be mounted inside the wall and defining at least two arcuate slots extending proximate to an edge of the mounting plate to facilitate an engagement of the mounting plate to a mounting structure arranged inside the wall, and at least one hole extending from a first surface to a second surface arranged opposite to the first surface; and an end cap removably engaged to the mounting plate and having a housing portion defining a chamber to receive the electrical connector and having a base defining a groove arranged to be aligned with the at least one hole of the mounting plate, wherein the groove and the hole facilitate an extension of a plurality of wires to the electrical connector to power the tape light.

2. The fixture of claim 1, wherein the housing portion includes a pair of parallel walls extending outwardly from the base, and a rear wall extending outwardly from the base and arranged between the pair of the parallel walls, and the end cap includes a cover adapted to be removably engaged with the pair of parallel walls and the rear wall covering an access opening of the housing portion, wherein the cover is an opaque cover.

3. The fixture of claim 2, wherein the housing portion includes a front opening defined between the pair of walls and the base to facilitate an extension of the tape light outside the housing portion.

4. The fixture of claim 1 further including a conduit extending through the groove and the hole, wherein the plurality of wires extends through the conduit.

5. The fixture of claim 1 further including an elongated channel structure adapted to be removably coupled to the housing portion and receive the tape light from the housing portion, and a lens removably coupled to the channel structure and covering the channel structure to facilitate a passage of light from the light emitting diodes to an ambient environment.

6. The fixture of claim 1, wherein the at least one hole includes a first hole and a second hole and the housing portion is a first housing portion, wherein the groove is aligned with the first hole and the tape light is a first tape light, and the end cap further includes a second housing portion defining a cavity and a bottom defining an opening aligned with the second hole to facilitate an extension of a plurality of cables to an electrical terminal to power a second tape light.

7. The fixture of claim 6, wherein the end cap includes a cover removably engaged to the second housing portion, wherein the cover is an opaque cover.

8. The fixture of claim 6 further including a conduit extending through the opening and the second hole, wherein the plurality of cables extends through the conduit.

9. The fixture of claim 6, wherein the end cap includes a channel portion having a substantially L-shape, wherein the first housing portion and the second housing portion intersects with the channel portion and respectively receive the first tape light and the second tape light from the first housing portion and the second housing portion, and at least one lens covering the channel portion to facilitate an exit of the light from the first tape light and the second tape light to an ambient environment.

10. The fixture of claim 9, wherein the channel portion includes a first sidewall and a second sidewall arranged spaced apart and opposite to the first sidewall, wherein the first tape light is supported on the first sidewall and the second tape light is supported on the second sidewall.

11. A light assembly, comprising:

at least one tape light having a plurality of light emitting diodes and an electrical connector connected to the tape light;

a mounting plate adapted to be mounted inside a wall and defining at least two arcuate slots extending proximate to an edge of the mounting plate to facilitate an engagement of the mounting plate to a mounting structure arranged inside the wall, and at least one hole extending from a first surface to a second surface arranged opposite to the first surface; and an end cap removably engaged to the mounting plate and adapted to be arranged inside the wall and having a housing portion defining a chamber to receive the electrical connector and having a base defining a groove arranged aligned with the at least one hole of the mounting plate, wherein the groove and the hole facilitate an extension of a plurality of wires to the electrical connector to power the at least one tape light.

12. The light assembly of claim 11, wherein the housing portion includes a pair of parallel walls extending outwardly from the base, and a rear wall extending outwardly from the base and arranged between the pair of the parallel walls, and the end cap includes a cover adapted to be removably engaged with the pair of parallel walls and the rear wall covering an access opening of the housing portion, wherein the cover is an opaque cover.

13. The light assembly of claim 12, wherein the housing portion includes a front opening defined between the pair of walls and the base to facilitate an extension of the tape light outside the housing portion.

14. The light assembly of claim 11 further including a conduit extending through the groove and the hole, wherein the plurality of wires extends through the conduit.

15. The light assembly of claim 11 further including an elongated channel structure adapted to be removably coupled to the housing portion and receive the tape light from the housing portion, and a lens removably coupled to the channel structure and covering the channel structure to facilitate a passage of light from the light emitting diodes to an ambient environment.

16. The light assembly of claim 11, wherein the at least one hole includes a first hole and a second hole, the housing portion is a first housing portion and the tape light is a first tape light, wherein the groove is aligned with the first hole, and the end cap further includes a second housing portion defining a cavity and a bottom defining an opening aligned with the second hole to facilitate an extension of a plurality of cables to an electrical terminal to power a second tape light.

17. The light assembly of claim 16, wherein the end cap includes a cover removably engaged to the second housing portion, wherein the cover is an opaque cover.

18. The light assembly of claim 16 further including a conduit extending through the opening and the second hole, wherein the plurality of cables extends through the conduit.

19. The light assembly of claim 16, wherein the end cap includes a channel portion having a substantially L-shape, wherein the first housing portion and the second housing portion intersects with the channel portion and respectively receive the first tape light and the second tape light from the first housing portion and the second housing portion, and at least one lens covering the channel portion to facilitate an exit of the light from the first tape light and the second tape light to an ambient environment.

20. The light assembly of claim 19, wherein the channel portion includes a first sidewall and a second sidewall arranged spaced apart and opposite to the first sidewall, wherein the first tape light is supported on the first sidewall and the second tape light is supported on the second sidewall.

* * * * *